US007007574B1

(12) United States Patent
Wu

(10) Patent No.: US 7,007,574 B1
(45) Date of Patent: Mar. 7, 2006

(54) GRIP STRUCTURE FOR A PRESSURE-BASED TOOL WITH SLEEVE

(76) Inventor: Geng-Hao Wu, No. 1, Hejiang St., Situn District, Taichung City (TW)

( * ) Notice: Subject to any disclaimer, the term of this patent is extended or adjusted under 35 U.S.C. 154(b) by 0 days.

(21) Appl. No.: 11/085,588

(22) Filed: Mar. 21, 2005

(51) Int. Cl.
*B25B 23/16* (2006.01)

(52) U.S. Cl. ..... 81/177.85; 81/177.5; 81/177.1

(58) Field of Classification Search ..... 81/177.85, 81/177.5, 177.1, 177.2
See application file for complete search history.

(56) References Cited

U.S. PATENT DOCUMENTS 6,267,032 B1 * 7/2001 Hsieh ..... 81/177.85
6,766,716 B1 * 7/2004 Lee ..... 81/60
6,874,392 B1 * 4/2005 Wu ..... 81/177.85
6,901,827 B1 * 6/2005 Yen ..... 81/177.85

* cited by examiner

*Primary Examiner*—Lee D. Wilson
*Assistant Examiner*—Alvin J Grant
(74) *Attorney, Agent, or Firm*—Egbert Law Offices

(57) ABSTRACT

A grip structure for a pressure-based tool has a main body, a grip, an operating rod, a flexible part, and a pressure block. The pressure block and operating rod are assembled in a groove of the main body. A bottom of the pressure block and a surface in the groove of the main body are set with an elastic supporter in between. A bottom of the pressure block is equipped with a groove so that a top of the elastic supporter contacts the bottom of the grip by passing through the groove. The grip is urged by the elastic supporter regardless of an upward or downward motion applied to the grip.

2 Claims, 9 Drawing Sheets

GRIP STRUCTURE FOR A PRESSURE-BASED TOOL WITH SLEEVE

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a grip structure for pressure-based tool with sleeve, and more particularly to a grip with elastic supporter connecting the bottom of the pressure block and main body groove, and whose top can be pressed against the bottom of the grip through pressure block through groove so that the grip can be pressed against by flexible part to maintain the tightness.

BACKGROUND OF THE INVENTION

The present invention provides an improved grip structure fore pressure-based tool with sleeve. The conventional grip structure comprises a ring-binding block which can be pressed downward to force the rod beneath it to decline simultaneously. The concave groove matches the preset height of the main body so that the steel ball could draw back inside the main body, and release the connecting sleeve. The lower part of the ring-binding block is assembled with a shrapnel so that it could be retracted to the original position under normal operation. The application of the said grip structure revealed the problem that the main body of the tool has a horizontal bar going through the main body and ring-binding block, thus the ring-binding block must move upward and downward. Therefore, a rectangular hole is reserved for the crossing of the horizontal bar. However, when the ring-binding block is pressed downward, the horizontal bar appears loosened at central space of the rectangular hole; hence, it causes the horizontal bar to move axially. Thus, it would affect the smoothness and stability of the operation. Also, even the ring-binding block is not pressed, the rod is unable to raise to the desired position due to insufficient distance of the skipped steel ball (maybe due to the wedge). Therefore, the horizontal bar is unable to position and slides randomly.

Thus, to overcome the aforementioned problems of the prior art, it would be an advancement if the art to provide an improved grip structure that can significantly improve the efficacy.

BRIEF SUMMARY OF THE INVENTION

The enhanced efficacy of the present invention is as follows:

1. The present invention provides a design in which the bottom of the pressure block and the fixed point of the groove of the main body are set with an elastic supporter in between. The bottom of the pressure block is equipped with a through groove that connects to the through hole upward, so that the top of the elastic supporter could reach the bottom of the grip by passing the through groove. It is a feature that meets the innovation requirement of invention.

2. With the given design, the pressure block allows the grip to be pressed against by the elastic supporter regardless of whether the motion is upward or downward, thus, it is able to maintain tightness against the main body and prevent random sliding.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Figure 1:
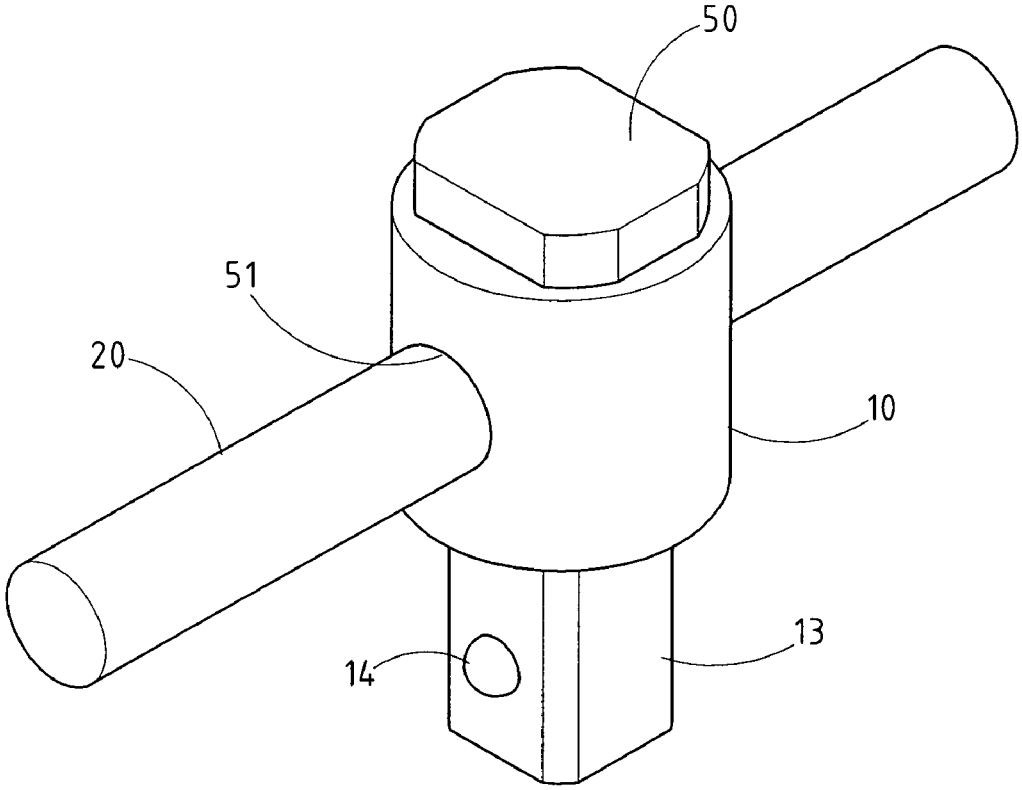
FIG. 1 shows an assembled perspective view of the present invention.
Figure 2:
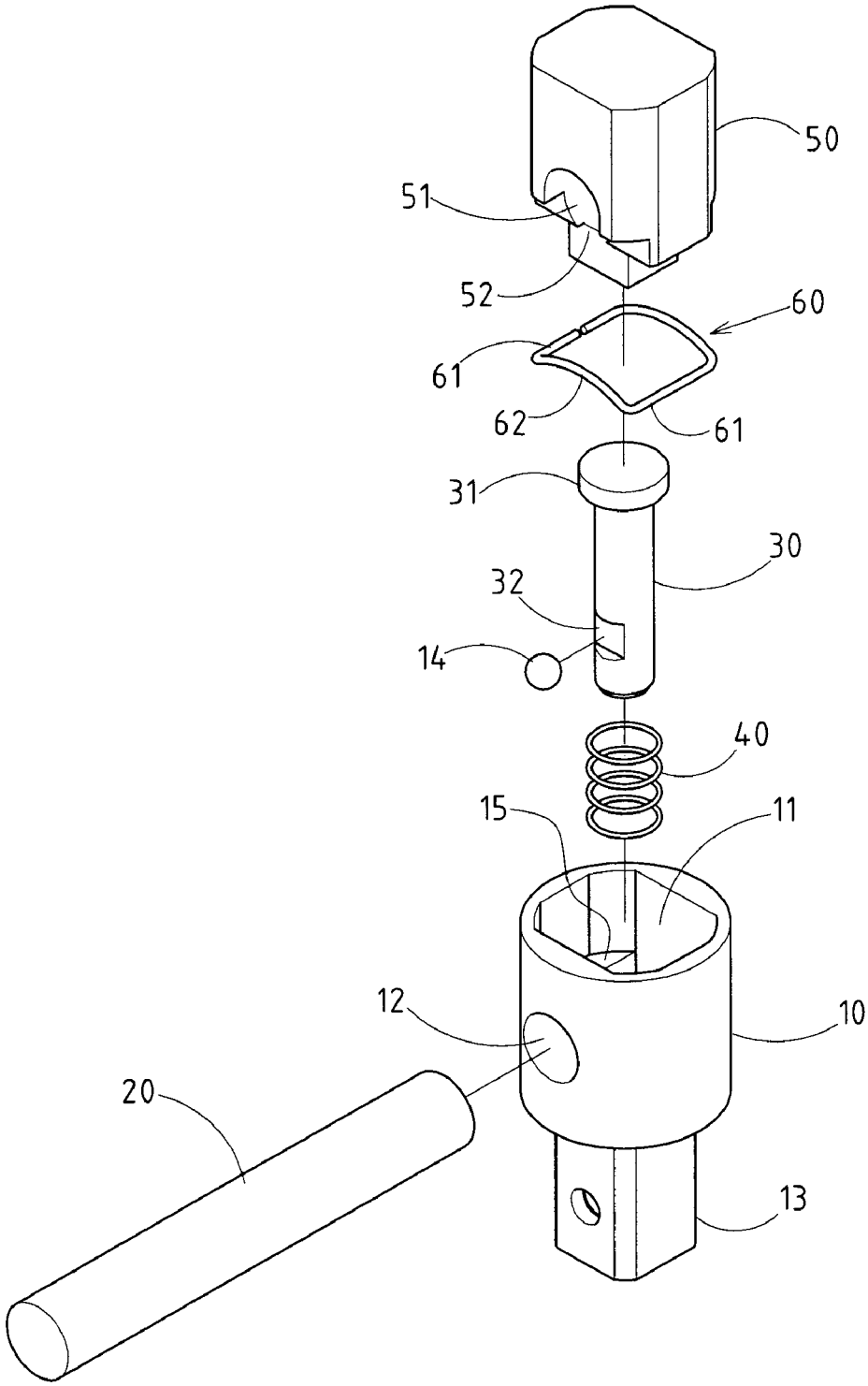
FIG. 2 shows an exploded perspective view of the present invention.
Figure 3:
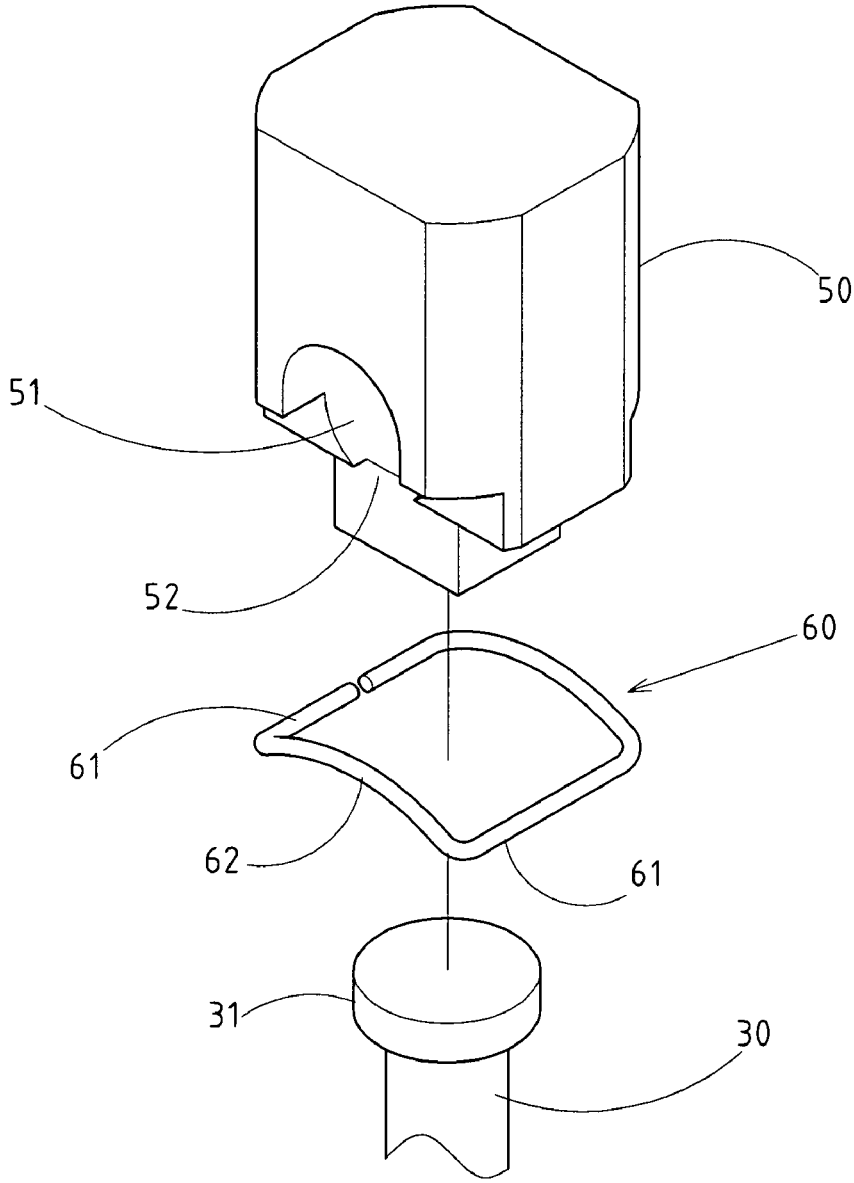
FIG. 3 shows a localized magnification of FIG. 2.

The features and the advantages of the present invention will be more readily understood upon a thoughtful deliberation of the following detailed description of a preferred embodiment of the present invention with reference to the accompanying drawings.

As shown in FIGS. 1–4, a grip structure for pressure-based tool with sleeve embodied in the present invention comprises: main body 10, grip 20, operating rod 30, flexible part 40, pressure block 50; whereas, the pressure block 50 and operating rod 30 are assembled in the groove 11 of main body 10 with one on the top of another; where as the crosswise wall of the pressure block 50 and main body 10 groove 11 is equipped with through hole 51 12 for the grip 20 to go through; whereas the flexible part 40 is installed between the protruding ring edge 31 of the top of operating rod 30 and the base wall of the groove 11, so that the operating rod 30 and pressure block 50 have the elasticity to support upward (when the pressure from the pressure block is relieved, it would reposition automatically); whereas one side of the bottom of the operating rod 30 has a concave edge 32, which concave edge provides a space for the steel ball 14 that is set at the sleeve connector 13 of the bottom of the main body 10 to draw back when the operating rod 30 moves downward, so as to release the sleeve. On the other hand, when the concave edge 32 moves upward with the operating rod 30, the vertical wall of the operating rod would push the steel ball 14 outward to wedge the connecting sleeve.

The bottom of the pressure block 50 and the fixed point of the groove 11 of the main body 10 are set with an elastic supporter 60 in between. The bottom of the pressure block 50 is equipped with through groove 52 that connects to the through hole 51 upward, so that the top of the elastic supporter 60 could reach the bottom of the grip 20 by passing the through groove 52. With the given design, the pressure block 50 allows the grip 20 to be pressed against by the elastic supporter 60 regardless of in upward or downward motion, thus, it is able to maintain tightness against the main body 10 and prevent random sliding.

In which, the elastic supporter 60 between the pressure block 50 and groove 11 of the main body 10 is arcuate and flexible, so that the fixed point of the groove 11 can be set at the shoulder 15 of the two sides of the groove bottom. Thus, the two ends 61 on the side of the elastic supporter 60 could be placed across the two shoulders 15. The central protruding top 62 of the elastic supporter 60 could press against the grip 20 by passing the through groove 52 of the pressure block 50.

Figure 6:
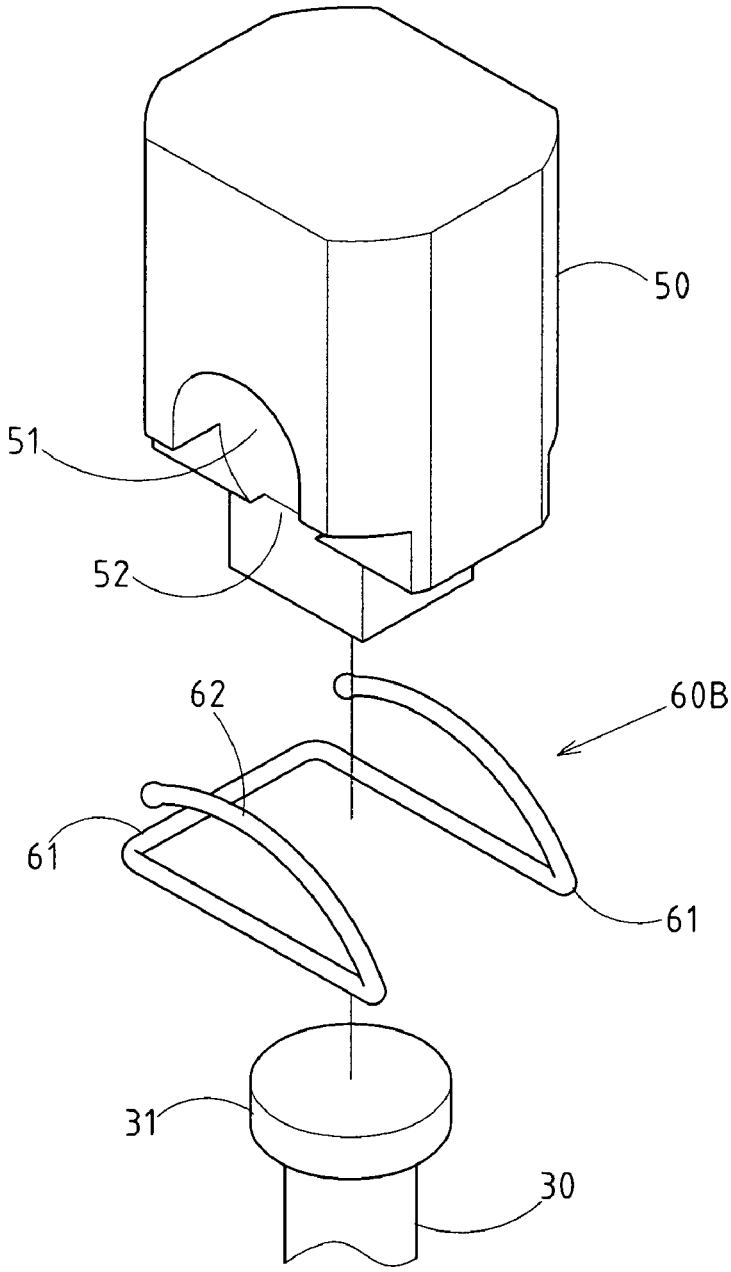
FIGS. 6–10 show exploded perspective views of the embodiments of the elastic supporting part of the present invention.
Figure 7:
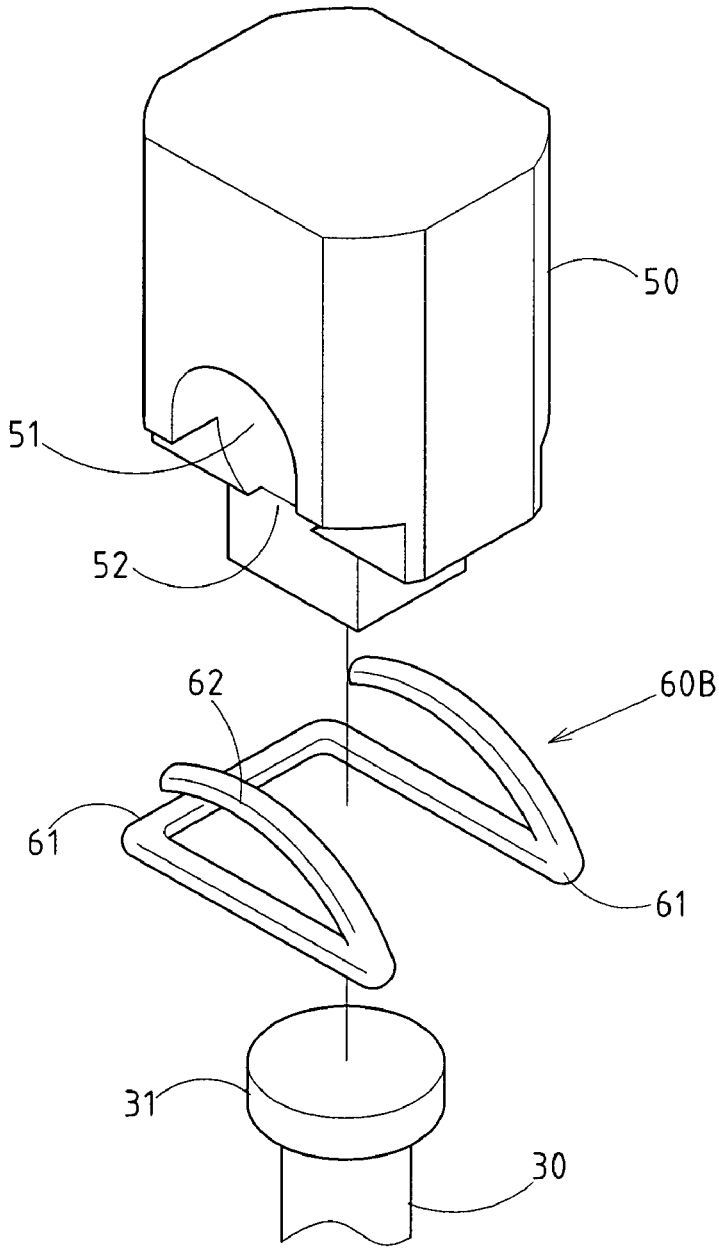
Figure 8:
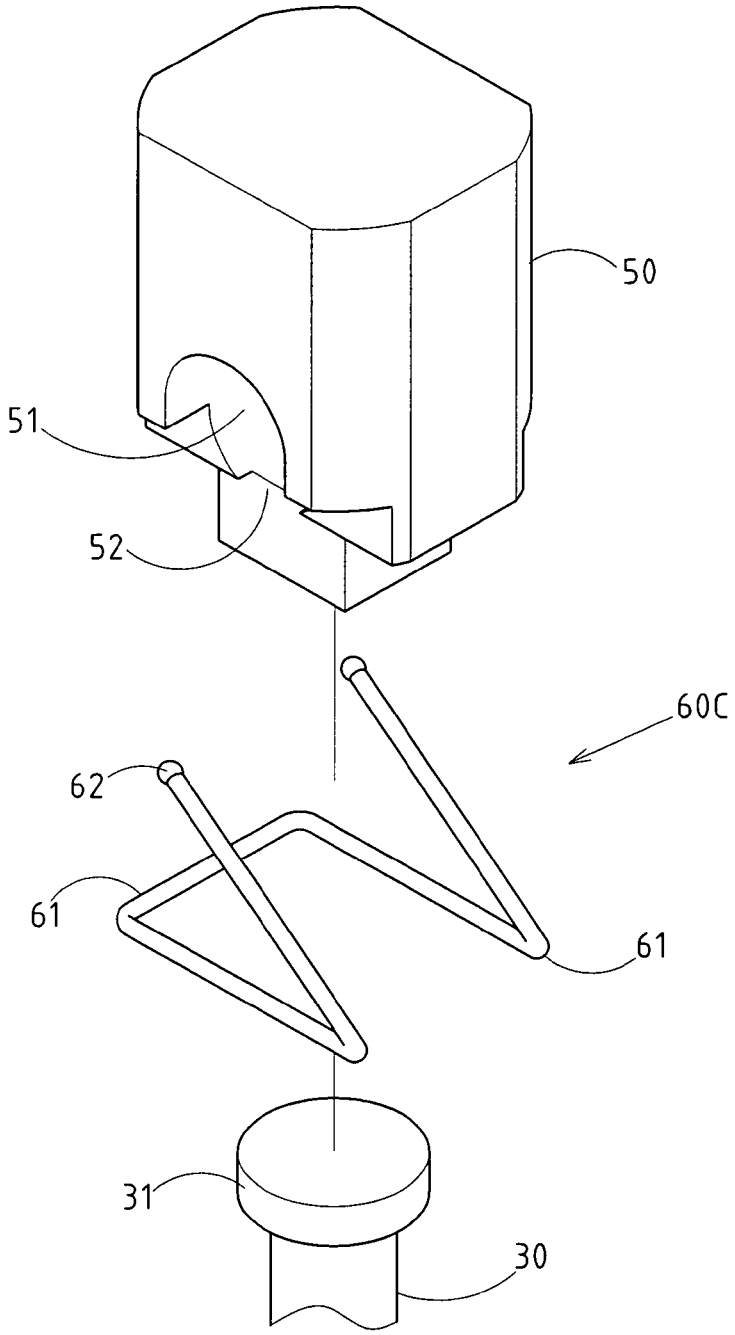
Figure 9:
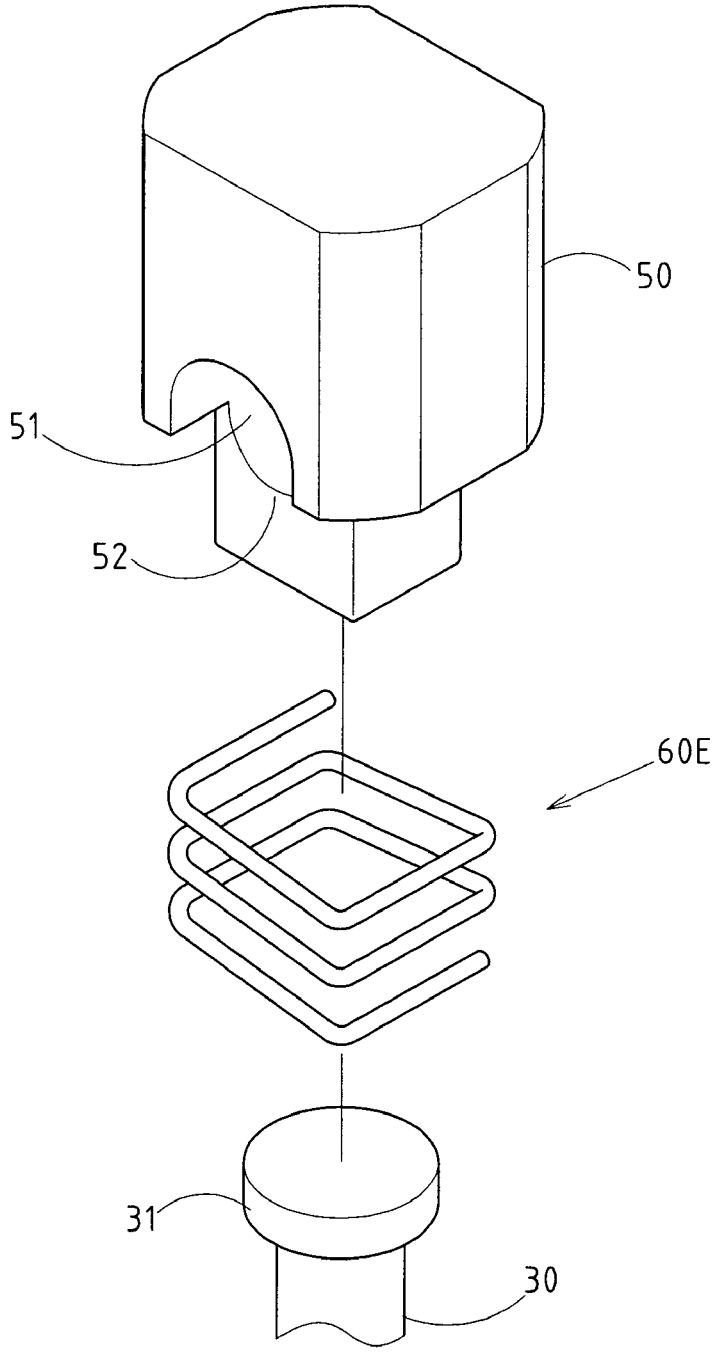
Figure 10:
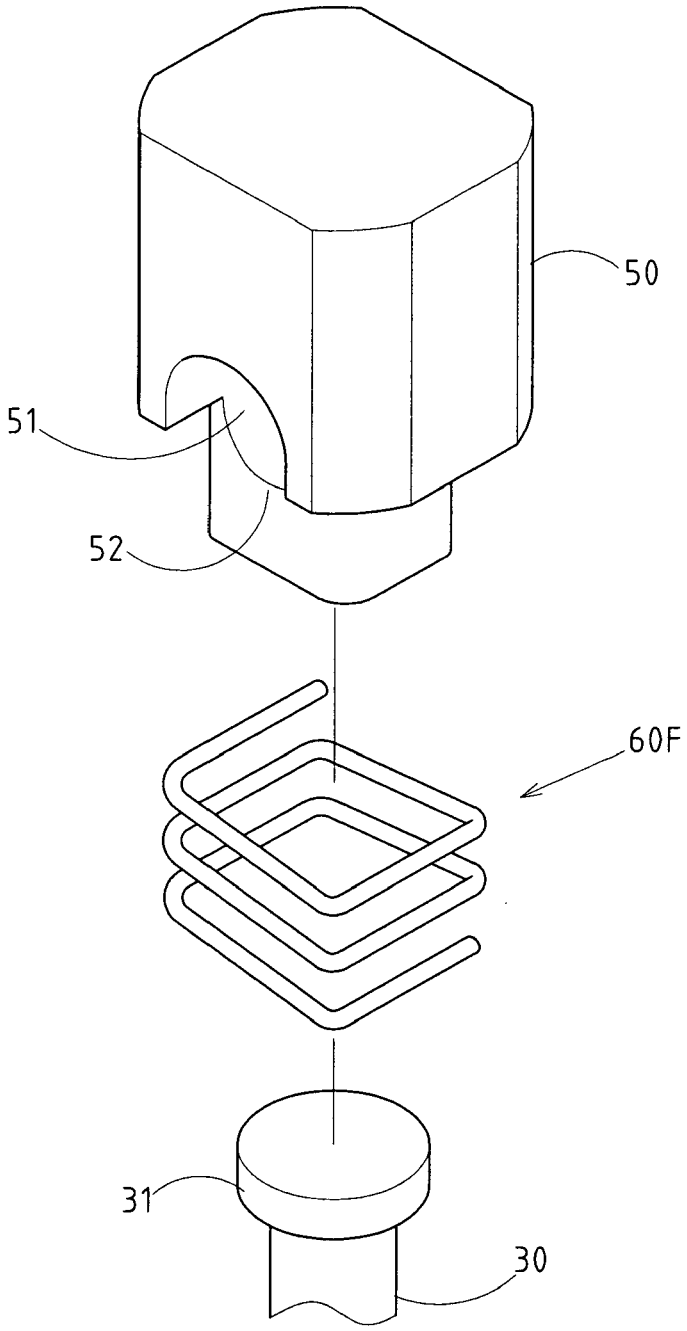

In which, the elastic supporter 60 could be formed in a square frame shape with single metal bar (as shown in FIG. 1). The elastic supporter 60B, as seen in FIG. 6, could form a □ shape with single metal bar, by bending two ends upward into an arch shape to form the central protruding top 62. The elastic supporter 60C, as seen in FIG. 7, differs from the one in FIG. 6 as it is a flat bar. The elastic supporter 60D, as seen in FIG. 8, could form a □ shape with single metal bar, by bending two ends upward into perpendicular lines to form the central protruding top 62. The elastic supporter could form a spiral shape with single metal bar. The elastic supporter 60E forms a rectangular spiral spring as seen in FIG. 9. The elastic supporter 60F forms a circular spiral spring as seen in FIG. 10.

Figure 4:
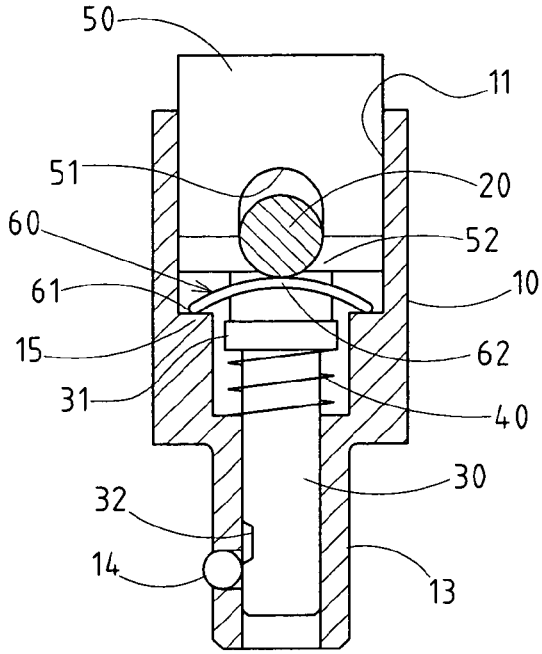
FIG. 4 shows an assembled sectional view of the present invention, whereas the pressure base is not pressed down.

Based on the abovementioned structure, the operation of the said grip structure for pressure-based tool with sleeve is as follows:

As shown in FIG. 4, before the pressure block 50 is pressed, the elasticity of the flexible part 40 provides the support upward so that the operating rod 30 and pressure block 50 are fixed in upward state. Under such state, the concave edge 32 of the operating rod 30 displaces the steel ball 14, so that the steel ball is pushed by the vertical wall of the operating rod, thus, protruding outward and wedging the connecting sleeve. On the other hand, the rise of the pressure block 50 forces the bottom wall of the through hole 51 to press against the grip 20, thus, as the top of the elastic supporter 60 presses against the bottom of the grip 20 by passing the through groove 52, the grip 20 is in a tightly closed position.

Figure 5:
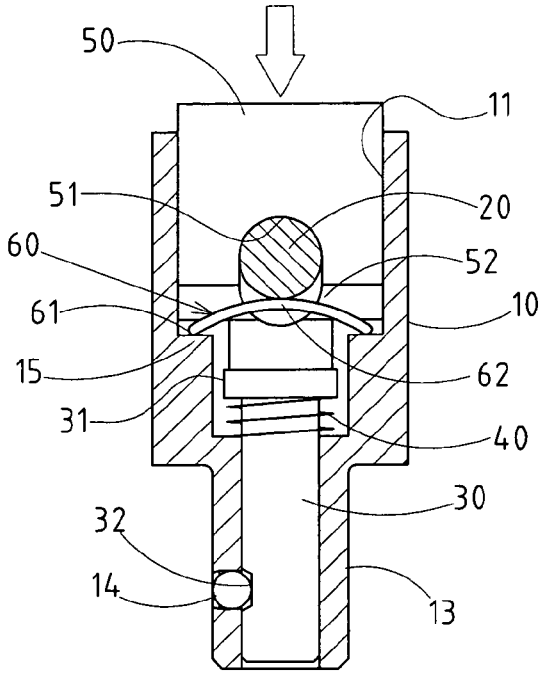
FIG. 5 shows another assembled sectional view of the present invention, whereas the pressure base is pressed down.

As shown in FIG. 5, when the pressure block 50 is pressed downward, the operating rod 30 descends simultaneously. Thus, the flexible part 40 is forced to compress, thus, displaces the concave edge 32 and steel ball 14, so that the steel ball goes back into the concave edge 32 to release the connecting sleeve. On the other hand, when the pressure block 50 descends, the top (central protruding top 62) of the elastic supporter 60 underneath it is going to pass the through groove 52 from the opposite direction to press against the grip 20, thus the grip and main body 10 could maintain the tightness in between and prevent random sliding.

I claim:

1. A grip structure for a pressure based tool comprising:

a main body having a groove therein and a through hole formed in a wall thereof, said groove having a base wall;

a pressure block assembled in said groove of said main body, said pressure block having a crosswise wall with a through hole formed therein, said pressure block having a bottom with a through groove that connects with said through hole of said pressure block;

an operating rod assembled within said groove of said main body below said pressure block, said operating rod having a protruding edge at a top thereof, said operating rod having a concave edge formed thereon;

a grip extending through said through holes of said main body and said pressure block;

a flexible part installed between said protruding ring edge of said operating rod and said base wall of said groove of said main body so as to elastically support said operating rod and said pressure block upwardly;

a sleeve connector positioned at a bottom of said main body, said sleeve connector having a receptacle formed in a wall thereof;

a steel ball received in said receptacle of said sleeve connector, a displacement of said operating rod allowing said steel ball to be moved between a first position wedged in said concave edge of said operating rod and a second position free of said concave edge;

an elastic supporter positioned between said bottom of said pressure block and a fixed point in said groove of said main body, said elastic supporter having a top that reaches a bottom of said grip by passing said through groove, said grip pressing against said elastic supporter regardless of an upward or downward motion applied to said grip.

2. The grip structure of claim 1, said elastic supporter being flexible and having an arcuate shape, said main body having a shoulder formed on two sides at a bottom in said groove, said fixed point being at said shoulders, said elastic supporter having a central protruding top passing into said through groove of said pressure block so as to press against said grip.

* * * * *